US007175424B2

(12) United States Patent
Frink et al.

(10) Patent No.: US 7,175,424 B2
(45) Date of Patent: Feb. 13, 2007

(54) INDOOR/OUTDOOR PATIO HEATER FIRE SCULPTURE

(76) Inventors: Toby Frink, 15451 Cottonwood Cir., Huntington Beach, CA (US) 92647; John A. MacPherson, 290 Blue Ridge Rd., Front Royal, VA (US) 22630

( * ) Notice: Subject to any disclaimer, the term of this patent is extended or adjusted under 35 U.S.C. 154(b) by 0 days.

(21) Appl. No.: 10/874,762

(22) Filed: Jun. 22, 2004

(65) Prior Publication Data

US 2004/0261780 A1 Dec. 30, 2004

Related U.S. Application Data

(60) Provisional application No. 60/480,945, filed on Jun. 24, 2003.

(51) Int. Cl.
*F24B 1/181* (2006.01)

(52) U.S. Cl. ..... 431/126; 126/519; 126/521; 126/92 B; 239/18

(58) Field of Classification Search ..... 126/92 B, 126/519, 521, 512, 500; 431/125, 126, 253, 431/350; 239/18, 20, 23; 362/96
See application file for complete search history.

(56) References Cited

U.S. PATENT DOCUMENTS

| | | | | |
|---|---|---|---|---|
| 517,361 | A * | 3/1894 | Pomeroy | 362/171 |
| 3,104,814 | A * | 9/1963 | Boerder | 239/18 |
| 3,830,217 | A * | 8/1974 | Maness et al. | 126/513 |
| 4,858,826 | A * | 8/1989 | Robinson et al. | 239/18 |
| 5,092,312 | A * | 3/1992 | Zolow | 126/500 |
| 5,738,084 | A | 4/1998 | Hussong | |
| 5,964,233 | A | 10/1999 | Clark et al. | |
| D429,324 | S | 8/2000 | Olson et al. | |
| 6,102,031 | A | 8/2000 | Waters | |
| D445,889 | S | 7/2001 | Resmo et al. | |
| D447,796 | S | 9/2001 | Rosmo et al. | |
| D450,816 | S | 11/2001 | Bilotti | |
| 6,422,232 | B1 | 7/2002 | Ashton et al. | |
| 6,446,623 | B1 | 9/2002 | Resmo et al. | |
| 6,470,877 | B1 | 10/2002 | Waters | |
| D466,993 | S | 12/2002 | Chang | |
| D471,622 | S | 3/2003 | Bossler | |
| D471,967 | S | 3/2003 | Bossler | |
| D472,623 | S | 4/2003 | Bossler | |

(Continued)

FOREIGN PATENT DOCUMENTS

| | | |
|---|---|---|
| EP | 976979 A1 | 2/2000 |

(Continued)

*Primary Examiner*—Josiah C. Cocks
(74) *Attorney, Agent, or Firm*—John F. Salazar; Middleton Reutlinger

(57) ABSTRACT

The present invention is an indoor/outdoor patio heater which includes a base portion housing a gas source, a gas burner, gas valve, a fan under the burner to create twisting flame patterns and a liquid pump, a pair of concentric see-through tubular portions disposed vertically above said base portion and a top heat deflector portion, with the burner flame enclosed by the inner tubular portion and liquid flowing through the channel formed between the inner and outer tubular portions to create the appearance of a twisting flame enclosed within a waterfall. The invention can be utilized with its aesthetic flame features and its aesthetic water features together, or one or the other.

18 Claims, 1 Drawing Sheet

U.S. PATENT DOCUMENTS 6,550,470 B2 4/2003 Liang
D474,532 S 5/2003 Chan et al.
6,651,647 B2 11/2003 Waters
6,736,132 B2 5/2004 Schlosser et al.
6,742,814 B2 6/2004 Resmo et al.
6,745,759 B2 6/2004 Bossler
6,799,727 B2 * 10/2004 Webster et al. ..... 237/49
6,901,925 B2 * 6/2005 Coughlin ..... 126/500
2001/0037804 A1 11/2001 Waters et al.
2003/0041855 A1 * 3/2003 Grady et al. ..... 126/519

FOREIGN PATENT DOCUMENTS

JP 8-252380 A * 8/1996
WO WO 91/18240 A1 * 11/1991

* cited by examiner

INDOOR/OUTDOOR PATIO HEATER FIRE SCULPTURE

PRIOR U.S. APPLICATION

This Specification is based on U.S. Provisional Application Ser. No. 60/480,945 filed on Jun. 24, 2003. The inventors claim the benefit of Title 35, Section 119 of the U.S. Code based on said provisional application.

BACKGROUND OF THE INVENTION

A. Technical Field

This invention relates generally to patio appliances and the like. More particularly, the present invention relates to patio heaters, particularly, but not by way of limitation, to an indoor/outdoor patio heater fire sculpture offering aesthetic features.

B. Background

Indoor/outdoor patios and porches have long been great gathering spots. It is generally desirable to extend the hours of the day and the seasons during which outdoor activities may be comfortably enjoyed. However, while relaxing on an indoor or outdoor patio, temperatures can fluctuate from comfortably warm to quite chilly, especially in the evening. Conventional patio heating appliances only serve as heaters and offer no aesthetic features. Many are also quite large, especially if used in a commercial setting.

It is also common for the heater and shroud to be supported on a post. In some instances, the post is mounted in the patio surface and gas is supplied from a central supply through gas tubing extending under the patio surface and up through the post to the heater. In other instances, the lower end of the post is mounted in a large base. Gas is supplied to the heater from a gas bottle mounted in the base. Such patio heaters require a large gas bottle. Therefore, the base must be of substantial size in order to accommodate the large gas bottle. Furthermore, the base must be of substantial size and weight in order to support the large patio heater safely so that it does not topple over due to winds or people leaning against it.

Patio heaters are in widespread use for the entertaining of friends, guests and family on decks, patios and the like. Various configurations and designs of these patio heaters are in use and known in the prior art. Examples are shown in U.S. Pat. No. 6,446,623 to Resmo et al. (2002) for a Miniature Patio Heater which shows a mini gas patio heater; U.S. Pat. No. 5,964,233 to Clark et al. (1999) for a Patio Umbrella with Radiant Heater describes a multi-element structure integrating an infrared radiation combustion heater with a large flammable cloth umbrella; U.S. Pat. No. 5,738,084 to Hussong (1998) for a Ventless Patio Fireplace describes a wheel and casters mounted portable fireplace with traditional fireplace configuration. The fireplace utilizes a liquid petroleum tank for the fuel source. Although these patio heaters are suitable for their intended purpose, they are not practical for home use on a patio wherein space is often limited and the size and weight of a large patio heater is prohibitive in that it cannot be easily moved around by persons in the household.

Nonetheless, the above-described approaches have not resolved the problem of providing heat and aesthetic value. Because of the above-described and other shortcomings of prior art patio heaters, there has been a long-felt need for a patio heater that is both effective for providing supplemental heat and that is also advantageously adapted to provide aesthetic value.

It is therefore an object of the present invention to provide an indoor/outdoor patio heater fire sculpture.

Another object of the present invention is to provide a patio heater fire sculpture that may be used outdoors or indoors as a vent free appliance. Still a further object of the present invention is to provide an indoor/outdoor patio heater fire sculpture offering functional and aesthetic features.

Yet a further object of the present invention is to provide an indoor/outdoor patio heater fire sculpture that can be operated with a flame from both natural and propane gas and a waterfall, or one or the other.

Another object of the present invention is to provide an indoor/outdoor patio heater fire sculpture that can be made in different sizes and heights, and has a variable speed fan that causes the flame to adjustably twist.

BRIEF DESCRIPTION OF THE DRAWINGS

The invention will be described below with reference to the accompanying drawing.

DETAILED DESCRIPTION OF THE PREFERRED EMBODIMENT

Figure 1:
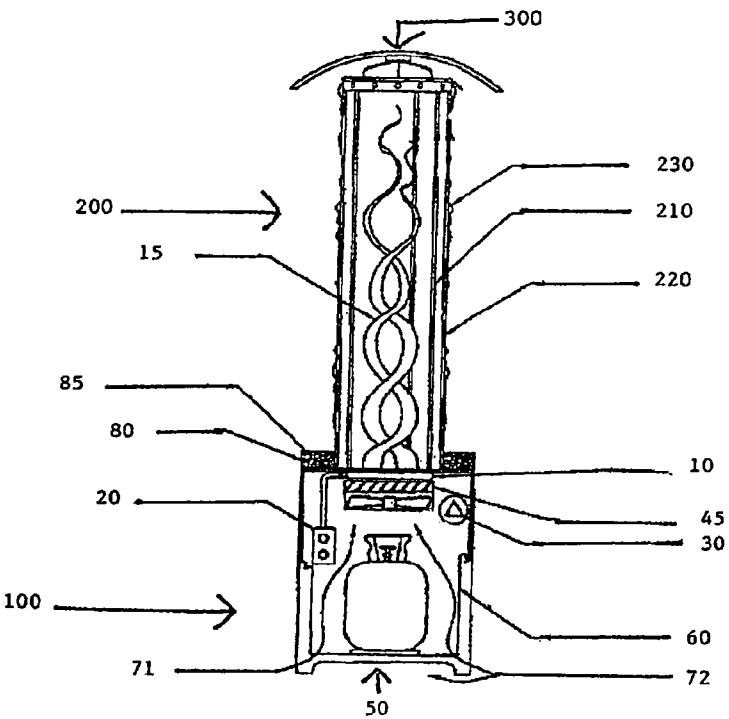
FIG. 1 is a cross sectional view of an indoor/outdoor portable patio gas heater sculpture embodying the invention.

Preferred operative embodiments espousing the principle objects of this invention will now be described. The patio heater of the present invention has application to essentially any commercially available patio heating appliance. For illustrative purposes, the present invention is described in the context for use with an indoor/outdoor patio heater fire sculpture. However, it should be appreciated that any patio heating device will benefit from and can incorporate the teachings of the present invention. Accordingly, the examples shown and described herein should be considered illustrative of the invention and not as restrictive.

According to an important aspect of the present invention, a patio heater is provided with a view of the flame and the added feature of a waterfall. The unit can be operated with the flame and waterfall or one or the other.

Referring to FIG. 1, the patio heater device 200 contemplated for use with the present invention generally comprises a base portion 100 that houses a gas supply source 50, a gas valve 20, a water pump 30, a fan 40 and associated equipment to operate the various systems. It also serves as a support for the main body of the unit. The base portion preferably also has an access door 60 disposed on a side surface thereof and more ventilation holes disposed through its surface. Optionally, the flame 15 is controlled in a flame tube 210 that extends up from the base 100 to the top heat deflector 300. Optionally, a large diameter tube 220 surrounds the flame tube 210 and serves as the medium for which the water 230 cascades down. Preferably, this outer tube 220 also serves as an insulator so the main body of the unit stays cool to the touch. More preferably, the top of the unit serves as the heat deflector 300, while at the same time housing the reservoir for the waterfall. The top 300 has an adjustable vent, which can be operated if heat is not desirable. The inner and outer tube portions are preferably made of glass but can be made of other non-flammable transparent rigid material. The liquid flow is preferably configured such that the water cascades down the exterior surface of the outer tube portion. The liquid used is preferably water but other non-flammable liquid could be used, or coloring could be added to water, to achieve various aesthetic waterfall effects.

In embodiments where the waterfall is not utilized, the space between the flame tube 210 and outer tube 220 is filled with air, preferably circulating air, to provide transparent insulation from the heat emanating from the flame tube so that the outer tube 220 surface is not hot to the touch. The fan 40 can be utilized to provide circulation in said space as well.

When the heater is put into operation, the fan 40 located in the base 100 affects the air patterns in the burner 10 tube and causes the flame 15 to twist. The amount of twist is varied by the speed of the fan 40. The fan 40 is preferably adjustable from no twist to a complete cyclone effect. An air deflector 45 is also preferably included between the fan 40 and the burner 10.

Referring to FIG. 1 in more detail, the present invention is an indoor/outdoor gas patio heater providing a view of a spiraling flame and a waterfall, comprising a base portion 100 having an opening at the top, which houses a gas supply source 50, a gas burner 10 disposed near said top opening of said base portion 100, an electric fan 40 disposed beneath said burner 10 for creation of twisting flame patterns emanating from said burner 10 when ignited, a gas supply valve 20 connected via tubing to said gas supply source 50 at one end and to said burner 10 at the other end, and an electric pump 30 for pumping liquid upwardly from said base portion 100; a hollow transparent tubular inner portion 210 having an open top end and an open bottom end disposed vertically over said top opening of said base portion 100 over said burner 10, which acts as a see-through burner heat conduit and flame chamber; a hollow transparent tubular outer portion 220 disposed concentrically around the exterior surface of said hollow inner tubular portion 210, forming an enclosed channel between said inner 210 and outer 220 tubular portions through which liquid is pumped upwardly by said electric pump 30 and cascades downwardly along the outer tube's outer vertical surface for recirculation; a top portion 300 resting over the top of said tubular inner 210 portion, through which heat emanating from said gas burner is deflected outwardly and, in a preferred embodiment, also including a liquid reservoir (not shown) that connects to said channel formed by said inner 210 and outer tubular 220 portions for holding liquid pumped upwardly by said pump and recirculation by cascading downwardly along the outer surface of said outer 220 tubular portion; a bottom reservoir or collecting tray 80 disposed at the top of base 100 and surrounding the outer tubular portion 220 to collect liquid cascading downwardly and connected to pump 30 for recirculation of the water upwardly; an electric power source (not shown) for driving said electric pump 30 and said electric fan 40, and liquid for circulation through said pump channel and tray. Said tray 80 can be integrally formed on the surface of base portion 100 or said outer tubular portion 220. The tray can optionally contain ornamental material, such as decorative gravel 85, pebbles, stones or liquid.

As discussed previously, the patio heater produces heat while also providing a view of the flame and the added feature of a waterfall. Additionally, the unit has the ability to be used indoors as a vent free appliance. It can be operated with a flame from natural and/or propane gas, and a waterfall, or one or the other. In those embodiments not utilizing the waterfall feature, the electric pump is not needed and instead air circulates in the channel between said inner 210 and outer 220 tubular portions to provide an insulating effect so that the outer surface of said outer tubular portion 220 is not hot to the touch. The fan 40 can be utilized to circulate air through said channel. The entire unit is mobile and can be located anywhere on a flat level surface. It is of size and weight that it can easily be moved around, indoors and outdoors, by persons in the household.

The indoor/outdoor patio heater fire sculpture can be made in different sizes and heights to accommodate special environments. The unit is available in both natural and propane gas and is convertible in the field.

While the present invention has been shown and described herein in what are considered to be the preferred embodiments thereof, illustrating the results and advantages over the prior art obtained through the present invention, the invention is not limited to those specific embodiments. Thus, the forms of the invention shown and described herein are to be taken as illustrative and other embodiments may be selected without departing from the spirit and scope of the present invention.

What is claimed is:

1. An indoor/outdoor gas patio heater providing a view of a spiraling flame and a waterfall, comprising:

a base portion having an opening at the top, which houses a gas supply source, a gas burner disposed near said top opening of said base portion, an electric fan disposed beneath said burner for creation of twisting flame patterns emanating from said burner when ignited, a gas supply valve connected via tubing to said gas supply source at one end and to said burner at the other end, and an electric pump for pumping liquid upwardly from said base portion;

a hollow transparent tubular inner portion having an open top end and an open bottom end disposed vertically over said top opening of said base portion over said burner, which acts as a see-through burner heat conduit and an enclosed flame chamber;

a hollow transparent tubular outer portion disposed concentrically around the exterior surface of said hollow inner tubular portion, forming an enclosed channel between said inner and outer tubular portions through which liquid is pumped upwardly by said electric pump and cascades downwardly along its outer surface for recirculation;

a top portion resting over the top of said tubular inner portion, through which heat emanating from said gas burner is deflected outwardly;

a tray disposed around the outer surface of the bottom end of said tubular outer portion and connected to said pump for collection of liquid cascading downwardly along the outer surface of said tubular outer portion; said flame chamber interior and coaxial with said tubular outer portion to separate said flame chamber from said liquid by said tubular outer portion;

an electric power source for driving said electric pump and said electric fan; and liquid for circulation through said pump, channel and tray.

2. The patio heater of claim 1, wherein said fan is adjustable in speed.

3. The patio heater of claim 1, wherein said top deflector portion further comprises an adjustable vent.

4. The patio heater of claim 1, wherein said base portion further comprises an air deflector disposed between said fan and said burner.

5. The patio heater of claim 1, wherein said base portion further comprises an access door disposed on a side surface thereof.

6. The patio heater of claim 1, wherein said base portion further comprises one or more air ventilation orifices disposed through its surface.

7. The patio heater of claim 1, wherein said top portion further comprises a liquid reservoir that connects to said channel formed by said inner and outer tubular portions for holding liquid pumped upwardly by said pump for recirculation by cascading downwardly along the outer surface of said tubular outer portion.

8. An indoor/outdoor gas patio heater providing aesthetic effects, comprising:

a base portion having an opening at the top, which houses a gas supply source, a gas burner disposed near said top opening of said base portion, an electric fan disposed beneath said burner for creation of twisting flame patterns emanating from said burner when ignited, and a gas supply valve connected via tubing to said gas supply source at one end and to said burner at the other end;

a hollow transparent tubular inner portion having an open top end and an open bottom end disposed vertically over said top opening of said base portion over said burner, which acts as a see-through burner heat conduit and flame chamber;

a hollow transparent tubular outer portion disposed concentrically around the exterior surface of said hollow inner tubular portion, and said flame chamber forming an enclosed channel between said inner and outer tubular portions which is filled with air;

a top portion resting over the top of said tubular inner portion, through which heat emanating from said gas burner is deflected outwardly; and an electric power source for driving said electric fan.

9. The patio heater of claim 8, wherein said fan causes air to circulate through said channel between said inner and said outer tubular portions.

10. The patio heater of claim 8, wherein said fan is adjustable in speed.

11. The patio heater of claim 8, wherein said top deflector portion further comprises an adjustable vent.

12. The patio heater of claim 8, wherein said base portion further comprises an air deflector disposed between said fan and said burner.

13. The patio heater of claim 8, wherein said base portion further comprises an access door disposed on a side surface thereof.

14. The patio heater of claim 8, wherein said base portion further comprises one or more air ventilation orifices disposed through its surface.

15. An indoor/outdoor gas patio heater providing aesthetic effects, comprising:

a base portion having an opening at the top, which houses a gas supply source, a gas burner disposed near said top opening of said base portion, a gas supply valve connected via tubing to said gas supply source at one end and to said burner at the other end, and an electric pump for pumping liquid upwardly from said base portion;

a hollow transparent tubular inner portion having an open top end and an open bottom end disposed vertically over said top opening of said base portion over said burner, which acts as a see-through burner heat conduit and flame chamber;

a hollow transparent tubular outer portion disposed concentrically around the exterior surface of said hollow inner tubular portion, forming an enclosed channel between said inner and outer tubular portions through which liquid is pumped upwardly by said electric pump and cascades downwardly along its outer surface for recirculation; said flame chamber interior of both said tubular outer portion and said tubular inner portion;

a top portion resting over the top of said tubular inner portion, through which heat emanating from said gas burner is deflected outwardly;

a tray disposed around the outer surface of the bottom end of said tubular outer portion and connected to said pump for collection of liquid cascading downwardly along the outer surface of said tubular outer portion;

an electric power source for driving said electric pump; and liquid for circulation through said pump, channel and tray.

16. The patio heater of claim 15, wherein said top deflector portion further comprises an adjustable vent.

17. The patio heater of claim 15, wherein said base portion further comprises an access door disposed on a side surface thereof.

18. The patio heater of claim 15, wherein said base portion further comprises one or more air ventilation orifices disposed through its surface.

* * * * *